US012018553B2

(12) United States Patent
Watson et al.

(10) Patent No.: US 12,018,553 B2
(45) Date of Patent: Jun. 25, 2024

(54) ELECTRIC SUBMERSIBLE PUMP SYSTEMS

(71) Applicant: Schlumberger Technology Corporation, Sugar Land, TX (US)

(72) Inventors: Arthur Ignatius Watson, Sugar Land, TX (US); Jose Angel Caridad Urena, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 17/995,200

(22) PCT Filed: Mar. 31, 2021

(86) PCT No.: PCT/US2021/025150

§ 371 (c)(1),
(2) Date: Sep. 30, 2022

(87) PCT Pub. No.: WO2021/202712

PCT Pub. Date: Oct. 7, 2021

(65) Prior Publication Data

US 2023/0167723 A1 Jun. 1, 2023

Related U.S. Application Data

(60) Provisional application No. 63/003,246, filed on Mar. 31, 2020.

(51) Int. Cl.

| | |
|---|---|
| ***E21B 43/12*** | (2006.01) |
| ***F04B 17/03*** | (2006.01) |
| ***F04B 47/06*** | (2006.01) |
| ***F04D 13/08*** | (2006.01) |
| ***F04D 29/10*** | (2006.01) |

(52) U.S. Cl.
CPC ..... *E21B 43/128* (2013.01); *F04B 17/03* (2013.01); *F04B 47/06* (2013.01); *F04D 13/08* (2013.01); *F04D 29/106* (2013.01)

(58) Field of Classification Search
CPC ..... F04B 17/03; F04B 47/06; F04D 13/08
See application file for complete search history.

(56) References Cited

U.S. PATENT DOCUMENTS

| | | | |
|---|---|---|---|
| 1,879,628 | A | 9/1932 | Mendenhall et al. |
| 2,455,022 | A | 11/1948 | Schmidt |
| 2,489,505 | A | 11/1949 | Schmidt |
| 2,569,741 | A | 10/1951 | Artunoff |
| 2,942,667 | A | 6/1960 | Birdwell et al. |

(Continued)

FOREIGN PATENT DOCUMENTS

WO 2013166392 A1 11/2013

OTHER PUBLICATIONS

International Search Report and Written Opinion issued in the PCT application PCT/US2021/025150, dated Jul. 9, 2021 (10 pages).

*Primary Examiner* — Brian O Peters
(74) *Attorney, Agent, or Firm* — Philippe Laguerre

(57) ABSTRACT

A protector for an electric submersible pump includes a plurality of chambers, with adjacent or consecutive pairs of chambers coupled, e.g., fluidly coupled, via a series or parallel body. The body defines two separate hydraulic circuits, which allows for the inclusion of a shaft seal, even when the body couples consecutive chambers in a parallel configuration or couples to a thrust bearing chamber. The shaft tube circuit can include a compensator and/or a relief valve.

11 Claims, 5 Drawing Sheets

(56) References Cited

U.S. PATENT DOCUMENTS

| | | | |
|---|---|---|---|
| 4,011,906 | A | 3/1977 | Alexander et al. |
| 4,421,999 | A | 12/1983 | Beavers et al. |
| 4,462,765 | A | 7/1984 | Rodkin et al. |
| 5,131,328 | A | 7/1992 | Chan |
| 5,134,328 | A | 7/1992 | Johnatakis et al. |
| 5,622,222 | A | 4/1997 | Wilson et al. |
| 6,015,266 | A | 1/2000 | Swatek |
| 6,242,829 | B1 | 6/2001 | Scarsdale |
| 6,268,672 | B1 | 7/2001 | Straub et al. |
| 6,307,290 | B1 | 10/2001 | Scarsdale |
| 6,554,580 | B1 | 4/2003 | Mayfield et al. |
| 6,602,059 | B1 | 8/2003 | Howell et al. |
| 6,688,860 | B2 | 2/2004 | Du et al. |
| 6,981,853 | B2 | 1/2006 | Du et al. |
| 7,387,157 | B2 | 6/2008 | Gambier et al. |
| 7,665,975 | B2 | 2/2010 | Parmeter |
| 7,741,744 | B2 | 6/2010 | Watson et al. |
| 7,753,129 | B2 | 7/2010 | Head |
| 8,807,966 | B2 | 8/2014 | Du et al. |
| 10,228,062 | B2 | 3/2019 | Howell et al. |
| 2004/0069501 | A1 | 4/2004 | Haugen et al. |
| 2005/0077040 | A1 | 4/2005 | Myers et al. |
| 2007/0074872 | A1 | 4/2007 | Du et al. |
| 2010/0202896 | A1 | 8/2010 | Du et al. |
| 2011/0014071 | A1 | 1/2011 | Du et al. |
| 2011/0042097 | A1 | 2/2011 | Stephenson et al. |
| 2012/0305253 | A1 | 12/2012 | O'Malley |
| 2014/0322038 | A1 | 10/2014 | Du et al. |
| 2017/0051829 | A1 | 2/2017 | Collins et al. |
| 2017/0074406 | A1 | 3/2017 | Howell et al. |
| 2018/0371885 | A1 | 12/2018 | Santos et al. |

ELECTRIC SUBMERSIBLE PUMP SYSTEMS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 63/003,246, filed Mar. 31, 2020, the entirety of which is incorporated by reference herein and should be considered part of this specification.

BACKGROUND

Field

The present disclosure generally relates to electric submersible pump (ESP) protectors or seal sections, and more particularly to protector configurations allowing for redundant shaft seals.

Description of the Related Art

Various types of artificial lift equipment and methods are available, for example, electric submersible pumps (ESPs). An ESP includes multiple centrifugal pump stages mounted in series, each stage including a rotating impeller and a stationary diffuser mounted on a shaft, which is coupled to a motor. In use, the motor rotates the shaft, which in turn rotates the impellers within the diffusers. Well fluid flows into the lowest stage and passes through the first impeller, which centrifuges the fluid radially outward such that the fluid gains energy in the form of velocity. Upon exiting the impeller, the fluid flows into the associated diffuser, where fluid velocity is converted to pressure. As the fluid moves through the pump stages, the fluid incrementally gains pressure until the fluid has sufficient energy to travel to the well surface.

SUMMARY

In some configurations, a protector for an electric submersible pump includes a shaft extending axially through the protector; at least one positive-sealing chamber disposed about the shaft; a shaft tube associated with the chamber, the shaft tube surrounding the shaft; and a body positioned axially at an end of the chamber, the protector configured to fluidly isolate a volume within the shaft tube from fluids inside and outside of the chamber.

The body can include a shaft seal about the shaft. The chamber can be or include an elastomer bag. The at least one positive-sealing chamber can include at least two positive-sealing chambers, and the body can be positioned axially between two consecutive positive-sealing chambers. The body can include a shaft seal about the shaft, and the consecutive positive-sealing chambers can be configured in parallel. Alternatively, the consecutive positive-sealing chambers can be configured in series with no shaft seal. The protector can include a shaft seal disposed axially between the positive-sealing chamber and a thrust bearing chamber.

The body can include a compensator configured to compensate for thermal expansion and/or contraction of oil within the shaft tube. The compensator can be or include an elastomer bag, an elastomer bellows, a metal bellows, a movable piston, a volume of compressible gas, or a column of fluid that is denser than well fluid. The protector can include a relief valve configured to relieve excess pressure in the shaft tube.

The protector can include a plurality of fluid pathways configured to fluidly isolate the volume within the shaft tube from the fluids inside and outside of the chamber into two separate hydraulic circuits. The positive-sealing chamber can be coupled to a bag frame, and two coaxial seals can be disposed between the bag frame and the body and configured to separate the volume within the shaft tube from the fluids inside and outside of the chamber.

In some configurations, a body for a protector of an electric submersible pump is configured to be positioned axially between two consecutive positive-sealing chambers of the protector and includes two fluidly isolated hydraulic circuits.

In some configurations, a protector includes such a body, a shaft, a plurality of positive-sealing chambers, a shaft tube associated with each chamber, each shaft tube surrounding the shaft, and a shaft seal associated with each body, wherein a first of the two fluidly isolated hydraulic circuits defines a volume partially bounded by the shaft, the shaft tube, and the shaft seal, and a second of the two fluidly isolated hydraulic circuits defines a volume inside and outside the chambers. The protector can include a compensator configured to compensate for thermal expansion and/or contraction of oil in the first of the two fluidly isolated hydraulic circuits. The compensator can be or include an elastomer bag, an elastomer bellows, a metal bellows, a movable piston, a volume of compressible gas, or a column of fluid that is denser than well fluid. The protector can include a relief valve configured to relieve excess pressure in the shaft tube. The positive-sealing chambers can be or include elastomer bags. The first and second fluidly isolated hydraulic circuits can be independent of relative rotational relationship between the positive-sealing chambers and the body.

The body can include a shaft seal and be configured to couple the two consecutive positive-sealing chambers in parallel. The body can be configured to couple the two consecutive positive-sealing chambers in series without including a shaft seal.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
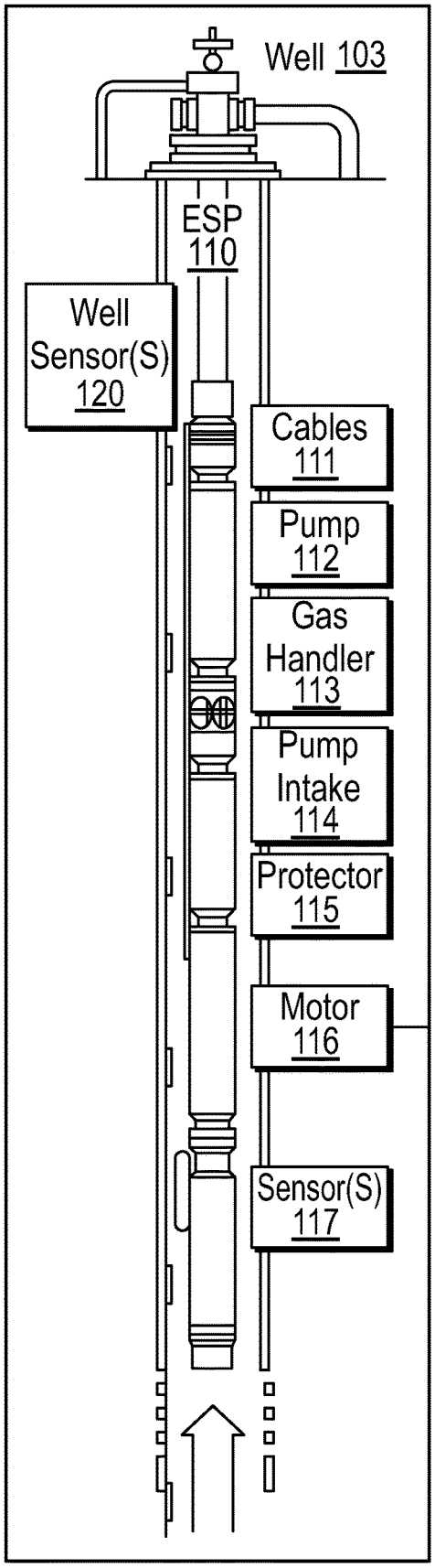
FIG. 1 shows a schematic of an electric submersible pump (ESP) system.

Various types of artificial lift equipment and methods are available, for example, electric submersible pumps (ESP). As shown in the example embodiment of FIG. 1, an ESP 110 typically includes a motor 116, a protector 115 (also known as a seal chamber section, a seal section, or a seal), a pump 112, a pump intake 114, and one or more cables 111, which can include an electric power cable. The motor 116 can be powered and controlled by a surface power supply and controller, respectively, via the cables 111. In some configurations, the ESP 110 also includes gas handling features 113 and/or one or more sensors 117 (e.g., for temperature, pressure, current leakage, vibration, etc.). As shown, the well may include one or more well sensors 120.

Figure 2A:
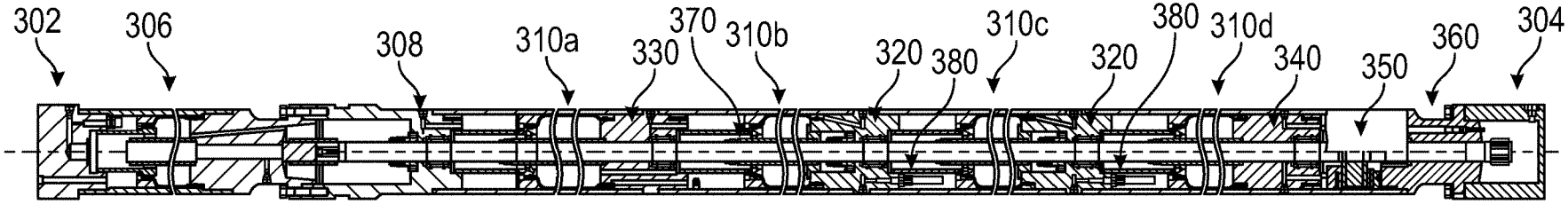
FIGS. 2A and 2B show cross-sectional views of an example embodiment of a protector.

The pump 112 includes multiple centrifugal pump stages mounted in series within a housing 230, as shown in FIG. 2A. Each stage includes a rotating impeller 210 and a stationary diffuser 220. One or more spacers 204 can be disposed axially between sequential impellers 210. A shaft 202 extends through the pump 112 (e.g., through central hubs or bores or the impellers 210 and diffusers 220) and is operatively coupled to the motor 116. The shaft 202 can be coupled to the protector 115 (e.g., a shaft of the protector), which in turn can be coupled to the motor 116 (e.g., a shaft of the motor). The impellers 210 are rotationally coupled, e.g., keyed, to the shaft 202. The diffusers 220 are coupled, e.g., rotationally fixed, to the housing 230. In use, the motor 116 causes rotation of the shaft 202 (for example, by rotating the protector 115 shaft, which rotates the pump shaft 202), which in turn rotates the impellers 210 relative to and within the stationary diffusers 220.

In use, well fluid flows into the first (lowest) stage of the ESP 110 and passes through an impeller 210, which centrifuges the fluid radially outward such that the fluid gains energy in the form of velocity. Upon exiting the impeller 210, the fluid makes a sharp turn to enter a diffuser 220, where the fluid's velocity is converted to pressure. The fluid then enters the next impeller 210 and diffuser 220 stage to repeat the process. As the fluid passes through the pump stages, the fluid incrementally gains pressure until the fluid has sufficient energy to travel to the well surface.

In use, the protector or seal section 115 compensates for thermal expansion and contraction of motor oil during on-off cycles and/or prevents or inhibits ingress of well fluids into the motor 116, which could cause electrical or mechanical failure of the motor 116. The protector 115 can have various configurations of chambers, for example, labyrinths (which operate via reverse gravity separation), dense barrier fluid, elastomer bags, and metal bellows. The length of each chamber is typically limited by the need to provide support to the shaft, for example, with radial bearing(s) in bodies between chambers. In cases in which the required volume of compensation can be accommodated in a single chamber, successive chambers in the protector 115 are typically configured in series to provide multiple layers of protection. In cases in which the required volume of compensation exceeds the capacity of a single chamber, successive chambers typically must be configured in parallel, such that their individual volumes act in combination. Parallel configurations are common in protectors 115 including elastomer bag and/or metal bellows chambers.

In a series configuration, an upper end of the protector bag is in communication with the shaft seal area, so the bags and shaft seals together form one fluid barrier and are dependent on each other. In a parallel configuration, the passageway from inside a lower bag to inside a next sequential upper bag is through the central bore, where the shaft seal would be located in a series configuration. Therefore, while there is a shaft seal in bodies between bags in a series configuration, there cannot be a functioning shaft seal in bodies between bags in a typical parallel configuration.

As redundant shaft seals are a critical line of defense against well fluid entry into the motor 116, the lack of shaft seals in a parallel configuration can disadvantageously decrease reliability. Additionally, the lowest body in the protector 115 cannot include a shaft seal if the chamber above it is in the form of a bag, because the bag must communicate to the thrust chamber via the central bore, which would be blocked if a shaft seal was present. Therefore, protectors 115 often include a labyrinth in the lower chamber, as a labyrinth allows for addition of a shaft seal in the lowest body. However, a labyrinth typically offers less protection from well fluid than a bag. Furthermore, a labyrinth just above the thrust bearing can trap gas that can be sucked down into the thrust bearing upon a system shutdown and cause bearing failure upon restart. When parallel chambers are required due to the required compensation volume, the protector 115 designer typically must choose between foregoing layers of protection (e.g., shaft seals) or adding another protector 115. However, more than two protectors is generally impractical due to, for example, cost and/or cumulative length shaft deflection.

Figure 2B:
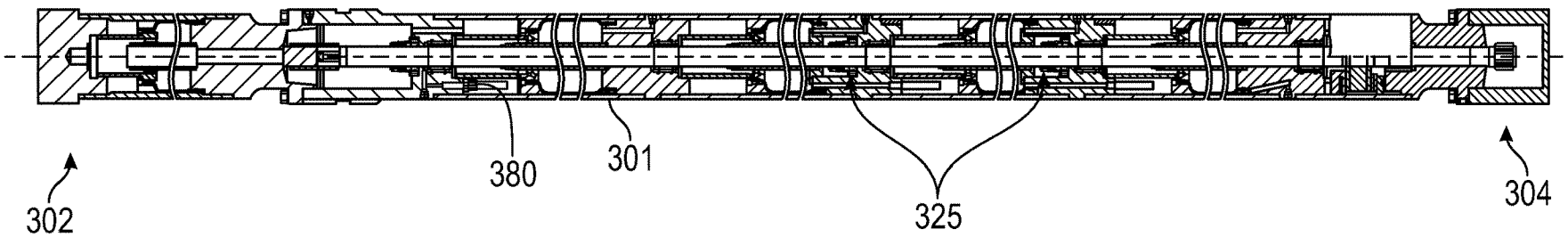

FIGS. 2A and 2B illustrate an example protector 115. The protector 115 includes a plurality of bags 310 and a plurality of bodies positioned between adjacent or consecutive pairs of bags 310. The bags 310 and bodies can be disposed within an outer housing 301. As shown, the protector 115 can include one or more series bodies 320 (in other words, a body that is positioned axially between and connects, e.g., fluidly connects, two adjacent or consecutive bags 310 in a series configuration) and/or one or more parallel bodies 330 (in other words, a body that is positioned axially between and connects, e.g., fluidly connects, two adjacent or consecutive bags 310 in a parallel configuration). A shaft tube 370 can be associated with each bag 310. The shaft tube 370 may support or provide an attachment point for the bag 310 and/or shield the protector shaft as it passes through the bags 310. An annular space between the shaft and shaft tube 370 can be filled or partially filled with a fluid, e.g., motor oil.

A compensating shipping cap 306, with may include a bag, can be positioned adjacent or proximate an upper end 302 of the protector 115. The protector 115 can include a head 308, which may include a shaft seal, below the compensating shipping cap 306 and/or above the protector bags 310. The protector 115 includes a base 360 adjacent or proximate a lower end 304 of the protector 115. The protector 115 includes a thrust bearing chamber 350 positioned above and adjacent or proximate the base 360.

The example protector 115 illustrated in FIGS. 2A and 2B has a bag-parallel body-bag-series body-bag-series body-bag configuration. A top or upper most bag 310*a* is coupled to the next lower adjacent, sequential, or consecutive bag 310*b* via a parallel body 330 such that bag 310*a* and bag 310*b* have a parallel configuration. The parallel body 330 does not include a shaft seal. Bag 310*b* is coupled to the next lower adjacent, sequential, or consecutive bag 310*c* via a series body 320. Bag 310*c* is also coupled to the next lower adjacent, sequential, or consecutive bag, which is a bottom or lower most bag 310*d*, via a series body 320. Each series body 320 includes a shaft seal 325. Each series body 320 can include a relief valve 380. In the illustrated configuration, the protector 115 includes a lower body 340 positioned below the bottom or lower most bag 310*d* and/or above the thrust bearing chamber 350. The lower body 340 does not include a shaft seal 325.

Although the examples illustrated and described herein primarily show and describe protector 115 chambers in the form of bags, e.g., elastomer bags, various features as shown and described herein can also be applied to other types of protector 115 chambers, for example, metal bellows, pistons, or other positive compensator or positive-sealing chambers.

In protectors 115 according to the present disclosure, the hydraulic circuit of the bags 310 is separated or isolated, e.g., fluidly separated or isolated, from the hydraulic circuit of the shaft seals 325 and shaft tubes 370. This separation or isolation advantageously enables or allows for the addition of a shaft seal 325 in a parallel body 330 and/or in the lowest body or base 360, which can advantageously increase reliability. This separation or isolation also isolates the shaft seals 325 from leakage into the bags 310 and isolates the bags 310 from leakage into the shaft seal 325. In other words, leakage into a bag 310 cannot bypass a shaft seal 325 and vice versa, so the shaft seals 325 and bags 310 are each independent, redundant systems.

In typical protectors 115, for example in the configurations shown in FIGS. 2A and 2B, the inside of each bag 310 is in communication with the inside of the shaft tube 370. A typical parallel body 330 does not include a shaft seal 325, which allows the fluid from the lower bag 310 and associated shaft tube 370 to be in communication with the upper bag 310 and associated shaft tube 370, for example through the central bore or around the shaft. Inclusion of a shaft seal 325 would block such fluid communication between the lower bag 310 (and/or associated shaft tube 370) and the upper bag 310 (and/or associated shaft tube 370), thereby separating the bags 310 in series. Furthermore, if a shaft seal were included in a parallel body, a passageway would need to be provided bypassing it, thereby rendering it non-functional.

Figure 3:
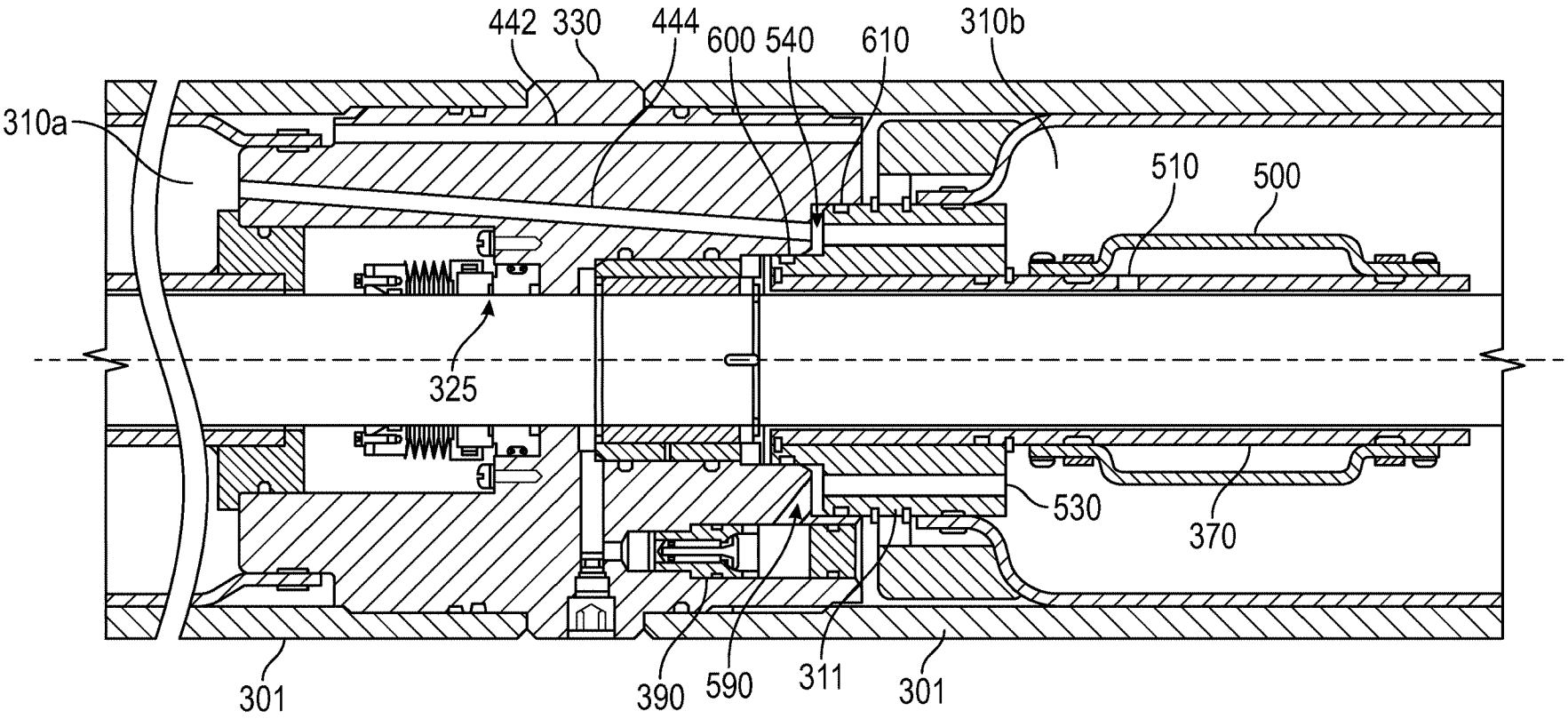
FIG. 3 shows a partial cross-sectional view of an example embodiment of a parallel body with a functioning shaft seal, including a sealed shaft tube equipped with a compensator and a relief valve.
Figure 4:
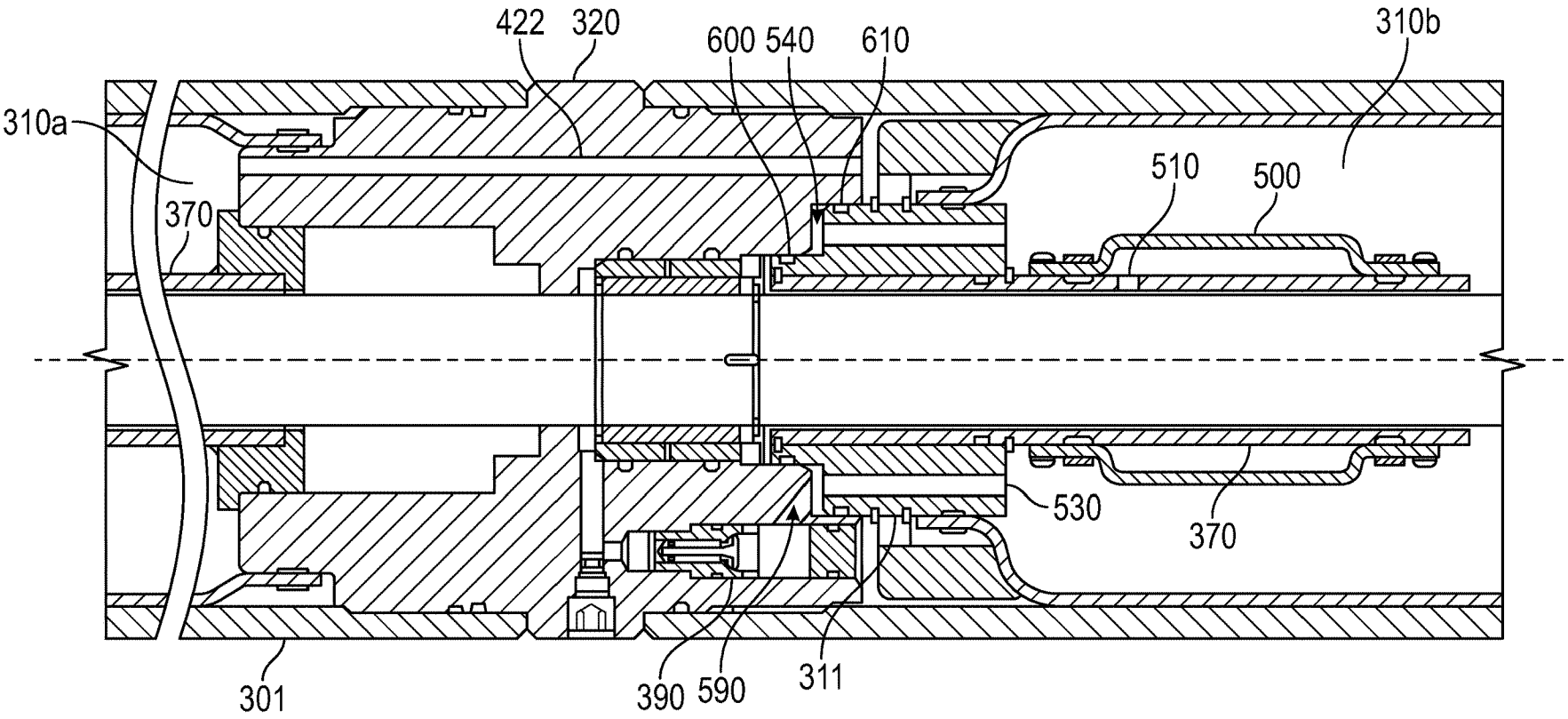
FIG. 4 shows a partial cross-sectional view of an example embodiment of a series body without a shaft seal, including a sealed shaft tube equipped with a compensator and a relief valve.

In contrast, the isolation of the volume inside the shaft tube 370 from the fluids inside and outside the bags 310, for example in the configurations illustrated in FIGS. 3 and 4, described in greater detail herein, allows a shaft seal 325 to be included (for example, as shown in FIG. 3) in or omitted (for example, as shown in FIG. 4) from the body, regardless of whether the body is a series 320 or parallel 330 body. This advantageously facilitates the inclusion of a greater number of redundant shaft seals 325, particularly, for example, in parallel configured bodies 330, the lowest body of the protector 115, and/or in a one-chamber protector, which can improve reliability and life-span of the system, as sequential invasion of shaft seals is a common life-limiting factor of an ESP. This can also allow for the shaft seal 325 to be omitted from the body 320 in a series configuration (for example as shown in FIG. 4), which can advantageously reduce cost. As the system of shaft seals 325 is independent from the system of bags 310, a leak in one of those systems does not bypass the other, unless either all of the shaft seals 325 or all of the bags 310 in the protector 115 are compromised. The volume inside the shaft tube 370 can be bound by a shaft seal 325 at each axial end.

FIGS. 3 and 4 illustrate example body configurations including a compensator 500. Such a compensator 500 and/or body configuration as illustrated can be used in a body in which the volume inside the shaft tubes 370 is isolated from the volume inside and outside the bags 310, for example, the bodies of FIGS. 3 and 4. The bodies of FIGS. 3 and 4 therefore include two separate hydraulic circuits. In use, the compensator 500 compensates for thermal expansion and contraction of the oil volume bounded by the shaft, shaft tubes 370, and shaft seals 325. The compensator can be or include, for example, an elastomer bag, an elastomer bellows, a metal bellows, a moveable piston, volume of compressible gas, a column of fluid, such as PFPE oil, that is denser than well fluid, or another suitable mechanism. In some configurations, the compensator includes a piston that moves axially in the hollow bore of the shaft in response to changes of oil volume. The shaft tube compensator can have flexibility or movement that allows the compensator to perform another function, such as a shaft seal bellows, a shaft tube, or a bag frame.

In some configurations, for example as shown in FIGS. 3 and 4, the compensator 500 includes an elastomeric tube, similar to a small protector bag, that encircles the shaft tube 370 and communicates with the interior of the shaft tube 370 through a hole 510 in the wall of the shaft tube 370. Ends of the elastomeric tube can be sealed to an outer diameter of the shaft tube 370, for example, via clamps or bands. A middle portion of the elastomeric tube may be enlarged to provide a compensation volume without stretching the tube. The compensator 500 can be located inside or outside the protector bag 310.

The compensator 500 is connected to another component, such as the body 320, 330, bag frame, shaft, and/or shaft tube 370. For example, the compensator 500 can be connected to the body 320, 330 and/or shaft tube 370 internally or externally to the body 320, 330 and/or shaft tube 370, and either directly or via a passageway, e.g., a fluid passageway. The compensator 500 can be connector to the other component via, for example, threads, threaded fasteners, interference fit, male-female seal, face seal, metal melting, adhesive, or entrapment between other components. If connected via a passageway, the passageway may pass through or between various protector components, such as the body, bag frame, shaft tube, shaft, e.g., a hollow shaft, or housing. For example, in the configurations of FIGS. 3 and 4, a passageway 510 in the wall of the shaft tube 370 communicates the interior of the shaft tube 370 with the compensator 500 located within the bag 310 below the shaft seal 325 where it is isolated by the bag(s) from possible chemical attack by well fluid.

In some configurations, the body 320 or 330 includes a relief valve 390 (separate from relief valve 380 shown in FIG. 2), which can relieve pressure on the compensator 500 when the compensator 500 is fully extended. For example, in the configurations of FIGS. 3 and 4, excess fluid discharged from relief valve 390 is discharged through passageway 590 into the bag 310*b* below the shaft seal 325 where the relief valve 390 is isolated by the bag(s) from possible chemical attack by well fluid or clogging with well solids. The relief valve 390 can be or include, for example, a spring-energized poppet with an elastomeric seal ring as shown. The relief valve 390 can be attached to the body with threads and can seal to the body via an o-ring. Alternatively, the relief valve 390 can be attached and sealed via, for example, sealing threads, e.g., pip threads, an interference fit, entrapment, or other means.

In some configurations, for example in protectors 115 having a smaller diameter and more limited radial space, the compensator 500 and/or relief valve 390 can be located above or below the body 320 or 330, for example, in an area between the body 320 or 330 and lower bag 310*b*, inside the bag 310, or between the bag 310 and the outer housing 301. In some configurations, for example in protectors 115 having a larger diameter, the compensator 500 and/or relief valve 390 can be contained, e.g., fully contained, partially contained, or substantially contained, within the body 320 or 330. Positioning of the compensator 500 and/or relief valve 390 fully or at least partially within the body 320, 330 can reduce or minimize the overall length of the assembly. In some configurations, the relief valve 390 can be located in a hollow bore of the shaft, which communicates to other regions.

In use, the compensator 500 and/or relief valve 390 can equalize pressure among various locations, including: the wellbore; the shaft tube 370 above the subject shaft tube 370, the shaft tube 370 below the subject shaft tube 370, the inside of the bag 310 above the subject shaft tube 370, the outside of the bag 310 above the subject shaft tube 370, the inside of the bag 310 surrounding the subject shaft tube 370, the outside of the bag 310 surrounding the subject shaft tube 370, the inside of the bag 310 below the subject shaft tube 370, the outside of the bag 310 below the subject shaft tube 370, the motor below it, and/or a sealed chamber. Pressure equalization can be selected to reduce or minimize the overall risk of well fluid entry into the motor. In some configurations the compensator 500 and relief valve 390 equalize pressure with the inside of the bag 310 below, or in the case of the lowest chamber, with the motor below it. This reduces or minimizes the chance of contamination by increasing or maximizing the available volume of the cleanest oil downstream. Such contamination could block expansion of the compensator 500 or inhibit full closure of the relief valve 390.

In the configurations of FIGS. 3 and 4, an upper end of the lower shaft tube 370 seals to a bag frame 311, which in turn seals to the body 320 or 330 with an inner seal 600 and an outer seal 610. A passageway 530 extends between and is in fluid communication with inside the lower bag 310*b* and a space 540 between the inner seal 600 and the outer seal 610 and between the bag frame 311 and the body 320 or 330.

In the parallel body 330 in FIG. 3, the space 540 is in fluid communication with a pathway 444 leading inside of the upper bag 310*a*. This arrangement allows for establishment of fluid communication between the bag frame 311 and the body pathways (e.g., pathway 444) even though the body 330 may be threadingly engaged with or coupled to the outer housing 301 and engages the bag frame 311 without any predetermined rotational orientation to the bag frame 311, while also isolating the bag frame 311 from the shaft tube 370 and shaft seal 325. Pathway 442 leads from outside the lower bag 310*b* to outside the upper bag 310*a*. The pathways 444 and 442 form part of the hydraulic circuit of the bags, which is separate from the hydraulic circuit of the shaft tube 370. The pathways 444 and 442 are configured such that the body 330 couples the upper 310*a* and lower 310*b* bags in parallel.

Figure 5:
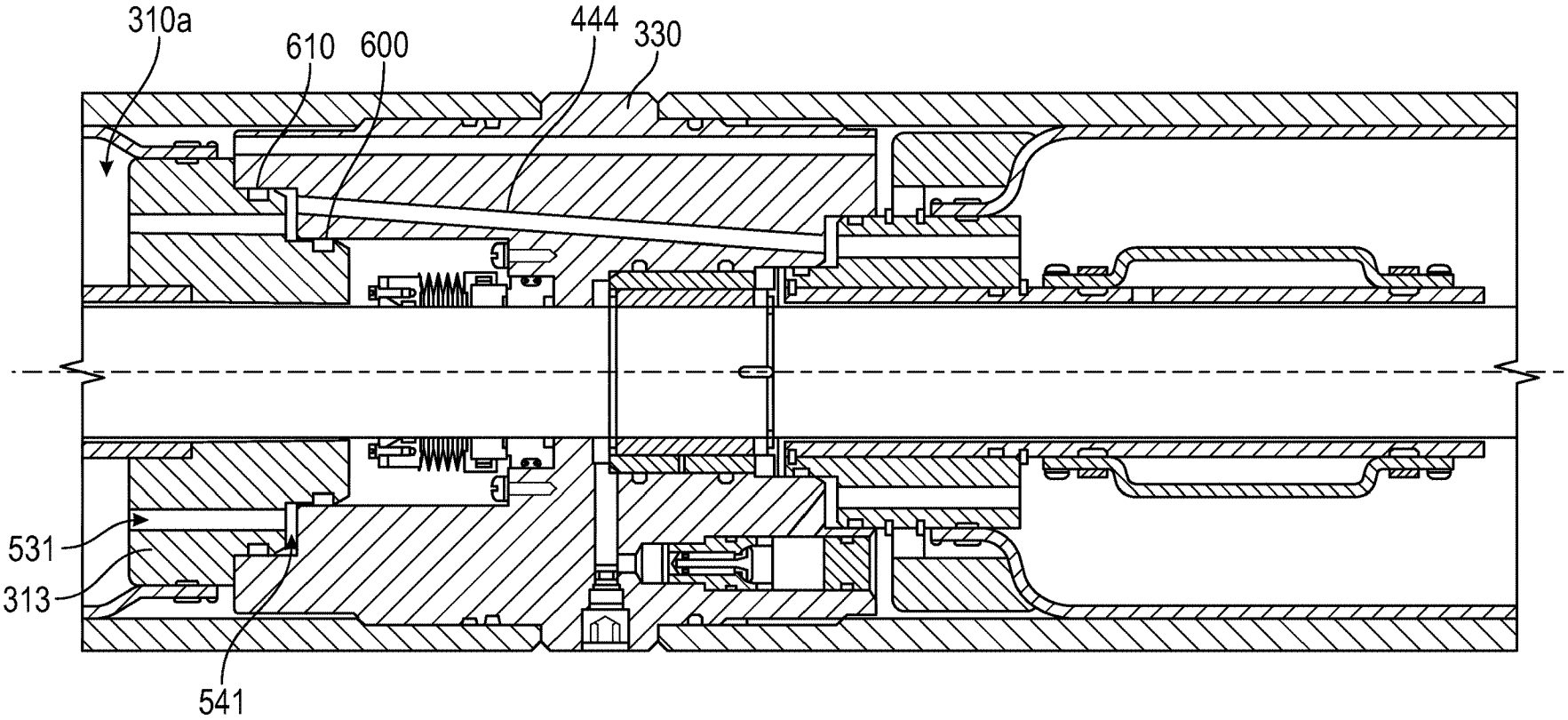
FIG. 5 shows a partial cross-sectional view of an example embodiment of a parallel body with a functioning shaft seal, including a sealed shaft tube equipped with a compensator and a relief valve.

FIG. 5 illustrates a parallel body 330 configuration similar to that shown in FIG. 3. However, whereas in FIG. 3 the lower end of the upper bag 310*a* is coupled directly to the body 330, in FIG. 5, the lower end of the upper bag 310*a* is coupled to a bag frame 313. The bag frame 313 seals to the body 320 or 330 with an inner seal 600 and an outer seal 610. A passageway 531 extends between and is in fluid communication with inside the upper bag 310*a* and a space 541 between the inner seal 600 and the outer seal 610 and between the bag frame 313 and the body 320 or 330. In the parallel body 330 illustrated in FIG. 5, the space 541 is in fluid communication with pathway 444 leading to space 540.

In the configurations illustrated in FIGS. 3-5, the inner 600 and outer 610 seals are disposed on the male component, which is the bag frame 311, 313 in the illustrated configurations. In the illustrated configurations, the seals 600, 610 are disposed in grooves in the outer diameter of the male component. The illustrated inner 600 and outer 610 seals are co-axial with each other, in different axial planes from each other, and of different diameters than each other. However, in various other configurations, the seals 600, 610 can be on the male or female component(s), co-axial or eccentric, in the same or different planes, and/or of the same or different diameters. The illustrated seals 600, 610 are elastomeric o-rings. In other configurations, the seals 600 and/or 610 can include or be made of various elastomers, polymers, metals, fiber, and/or any combination thereof.

In the series body 320 in FIG. 4, the space 540 is in fluid communication with a relief valve 380 (shown in FIG. 2) that discharges to the area outside of the lower bag 310*b*. This arrangement allows for establishment of fluid communication between the bag frame 311 and the relief valve 380 without any predetermined relative rotational orientation. The area outside of the lower bag 310*b* is in fluid communication with a pathway 422 leading to the inside of upper bag 310*a*. Pathway 422 forms part of the hydraulic circuit of the bags, which is separate from the hydraulic circuit of the shaft tube 370, and is configured such that the body 320 couples the upper 310*a* and lower 310*b* bags in series. As shown in FIG. 4, a shaft seal can be omitted.

In some configurations, the body 320 or 330 includes an "S" or seal port leading to the region just below the shaft seal 325 and an "F" or fill port leading to the region just above the shaft seal 325. These ports can be used for vacuum filling the shaft tube 370 with oil, for example, with vacuum pulled on the S port and oil pumped into the F port. As the shaft tube 370 is isolated from the bags 310, the S and F ports may not be in communication with the pathways 442 or 444 that extend through the body 320 or 330 in series or parallel configuration, respectively.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A protector for an electric submersible pump, the protector comprising:

a shaft extending axially through the protector;

at least one a positive-sealing chamber disposed about the shaft;

a shaft tube within the chamber, the shaft tube surrounding the shaft;

a body positioned axially at an end of the at least one positive-sealing chamber; and the protector configured to fluidly isolate from each other a volume within the shaft tube, a volume inside the at least one positive-sealing chamber, and a volume outside the at least one positive-sealing chamber.

2. The protector of claim 1, wherein the at least one positive-sealing chamber is coupled to a component, further comprising at least one seal between the component and the body, wherein the component is a bag frame and the at least one seal comprises at least one coaxial seal.

3. The protector of claim 1, wherein the chamber comprises an elastomer bag.

4. The protector of claim 1, wherein the at least one positive-sealing chamber comprises at least two positive-sealing chambers and the body is positioned axially between two consecutive positive-sealing chambers, the body comprising a shaft seal about the shaft and the consecutive positive-sealing chambers configured in parallel.

5. The protector of claim 1, further comprising a shaft seal disposed axially between the positive-sealing chamber and a thrust bearing chamber.

6. The protector of claim 1, wherein the at least one positive-sealing chamber comprises at least two positive-sealing chambers and the body is positioned axially between two consecutive positive-sealing chambers, the consecutive positive-sealing chambers configured in series with no shaft seal.

7. The protector of claim 1, the protector body comprising a compensator configured to compensate for thermal expansion and/or contraction of oil within the shaft tube.

8. The protector of claim 7, wherein the compensator comprises an elastomer bag, an elastomer bellows, a metal bellows, a movable piston, a volume of compressible gas, or a column of fluid that is denser than well fluid.

9. The protector of claim 1, further comprising a relief valve configured to relieve excess pressure in the shaft tube.

10. The protector of claim 1, the protector comprising a plurality of fluid pathways configured to fluidly isolate the volume within the shaft tube from the fluids inside and outside of the chamber into two separate hydraulic circuits.

11. The protector of claim 1, wherein the component is a bag frame and the at least one seal comprises at least one coaxial seal.

* * * * *